US009790019B2

(12) United States Patent
Brouwer et al.

(10) Patent No.: US 9,790,019 B2
(45) Date of Patent: Oct. 17, 2017

(54) FOAM DISPENSER

(71) Applicant: Airopack Technology Group B.V., Waalwijk (NL)

(72) Inventors: Mark Brouwer, Heesch (NL); Willy Leonard A. Kegels, Sint-Gillis-Waas (BE)

(73) Assignee: Airopack Technology Group B.V., Waalwijk (NL)

( * ) Notice: Subject to any disclaimer, the term of this patent is extended or adjusted under 35 U.S.C. 154(b) by 0 days.

(21) Appl. No.: 14/905,718

(22) PCT Filed: Jul. 17, 2014

(86) PCT No.: PCT/IB2014/063188
§ 371 (c)(1),
(2) Date: Jan. 15, 2016

(87) PCT Pub. No.: WO2015/008250
PCT Pub. Date: Jan. 22, 2015

(65) Prior Publication Data

US 2016/0159556 A1 Jun. 9, 2016

(30) Foreign Application Priority Data

Jul. 17, 2013 (CH) ..... 1278/13

(51) Int. Cl.

| | |
|---|---|
| ***B65D 83/66*** | (2006.01) |
| ***B65D 83/64*** | (2006.01) |
| ***B65D 83/20*** | (2006.01) |
| ***B65D 83/32*** | (2006.01) |
| ***B65D 83/44*** | (2006.01) |

(52) U.S. Cl.
CPC ..... *B65D 83/663* (2013.01); *B65D 83/20* (2013.01); *B65D 83/32* (2013.01); *B65D 83/44* (2013.01); *B65D 83/64* (2013.01)

(58) Field of Classification Search
CPC ..... B65D 83/20; B65D 83/32; B65D 83/44; B65D 83/64; B65D 83/663
See application file for complete search history.

(56) References Cited

U.S. PATENT DOCUMENTS 3,258,163 A * 6/1966 Brush ..... B65D 83/663 222/399
3,460,714 A 8/1969 Mace
(Continued)

FOREIGN PATENT DOCUMENTS

FR 2710617 * 4/1995
WO 2005/082744 A1 9/2005

OTHER PUBLICATIONS

International Search Report, mailed Jan. 15, 2015, for International Application No. PCT/IB2014/063188, 3 pages.
(Continued)

*Primary Examiner* — Frederick C Nicolas
*Assistant Examiner* — Bob Zadeh
(74) *Attorney, Agent, or Firm* — Seed IP Law Group LLP

(57) ABSTRACT

A novel foam dispenser is described, which comprises a dispensing container, a valve with a downstream foaming chamber and a pressure control device for maintaining a constant pressure in the container, such that uniform and compact foam will be created.

7 Claims, 3 Drawing Sheets

(56) References Cited

U.S. PATENT DOCUMENTS

| | | | | |
|---|---|---|---|---|
| 3,955,720 | A * | 5/1976 | Malone | B05B 7/0037 222/396 |
| 3,995,778 | A * | 12/1976 | Gamadia | A61K 8/8147 222/399 |
| 5,044,525 | A * | 9/1991 | McKinney | B65D 83/0016 222/326 |
| 5,110,014 | A * | 5/1992 | Doundoulakis | B67D 1/0412 222/396 |
| 5,248,495 | A | 9/1993 | Patterson et al. | |
| 6,536,685 | B2 * | 3/2003 | Bennett | B05B 7/0037 239/337 |
| 7,708,171 | B2 * | 5/2010 | Regan | B65D 83/64 222/389 |
| 7,954,678 | B2 * | 6/2011 | Regan | B65D 83/663 222/389 |
| 2002/0130198 | A1 | 9/2002 | Bennett | |
| 2003/0075568 | A1 * | 4/2003 | van 't Hoff | B65D 83/64 222/389 |
| 2016/0159556 | A1 * | 6/2016 | Brouwer | B65D 83/64 222/399 |

OTHER PUBLICATIONS

Written Opinion, mailed Jan. 15, 2015, for International Application No. PCT/IB2014/063188, 5 pages.

* cited by examiner

FOAM DISPENSER

BACKGROUND

Technical Field

The present disclosure is related to a foam dispenser.

Description of the Related Art

Foam dispensers for dispensing foam, like shaving-foam or hair foam and the like, from a container are used in daily life.

It is known to use a foam pump with a dip tube which is screwed on a container for foam dispensers. On the other hand aerosol containers are used with a foaming member comprising a foaming chamber with a mesh for producing the foam. Although spraying and foaming dispensers with aerosols are still in use, there are environmental reasons to use only foam pumps based on pressurized air. Since the pressure of the air created by a foam pump depends on the pumping action, the quality of the foam can differ for each pumping action.

BRIEF SUMMARY

Embodiments of the present invention provide a foam dispenser which creates foam of constant quality.

In one embodiment of the invention the valve comprises a valve stem and a pre-mixing chamber with orifices for entry of the pressurized gas, and a dip-tube is connected to the valve.

In another embodiment the foaming chamber comprises two adjacent meshes for producing foam and an entry for mounting on the valve stem.

In a further embodiment of the invention the entry of the foaming chamber has a reduced diameter with respect to the diameter of the valve stem.

In a further embodiment a piston with a hole is provided within the container, wherein the dip-tube is penetrating the piston through the hole.

In another embodiment of the invention the hole is sealed to the dip-tube by a sealing O-ring or by sealing lips.

In another further embodiment the piston is dome-shaped.

In some instances the piston has an outer sealing ring with an upper sealing lip and a lower sealing lip.

BRIEF DESCRIPTION OF THE SEVERAL VIEWS OF THE DRAWINGS

Embodiments of the invention will now be described in greater detail, by way of example, with reference to the accompanying drawings, in which.

DETAILED DESCRIPTION

In the figures the same reference numbers are assigned to the same elements, if nothing else is mentioned.

Figure 1:
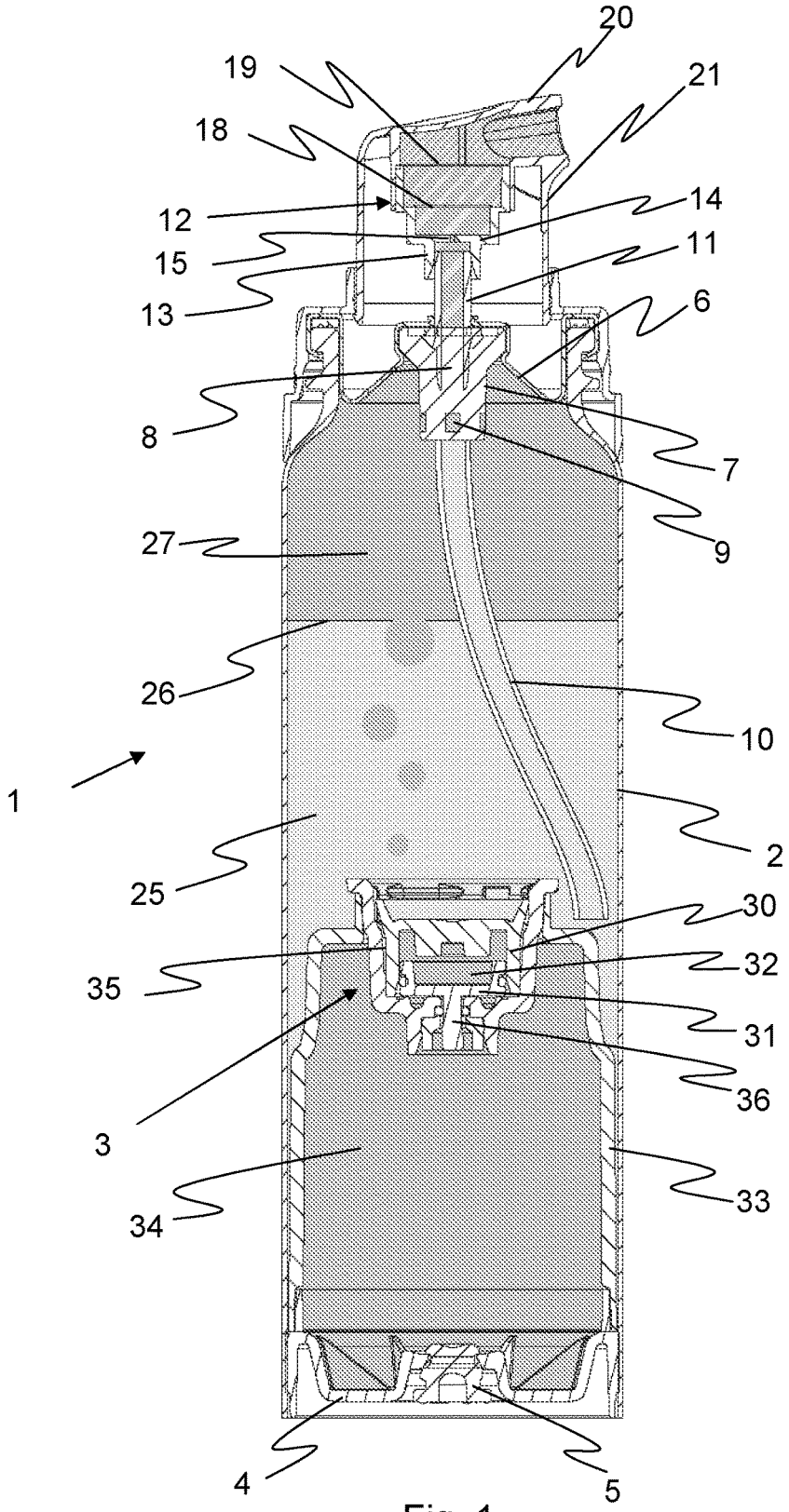
FIG. 1 shows a foam dispenser with a container and a pressure control device.

In FIG. 1 a foam dispenser 1 is depicted with a plastic container 2 and a pressure control device 3 as described extensively in WO-A-2005/082744, having a cup-like first cylinder 30, a piston 31 movable in a reciprocating manner within the first cylinder 30, so that a first chamber 32 is defined between the piston 31 and the first cylinder 30.

Further, a high pressure container or second cylinder 33 is provided which encloses at its top the first cylinder 30 and defines a second chamber 34. A passageway 35 is leading from the second chamber 34 to the outside of the pressure control device 3 into the container 2. A valve 36 is releasing and closing the passageway 35. The first chamber 32 is filled with a gas exerting a predetermined excess pressure and the second chamber 34 is filled with a gas at a pressure higher than the predetermined excess pressure. The piston 31 has means for actuating the valve 36 dependent from the pressure difference between the first chamber 32 and the container 2, so that if the fluid pressure in the container 2 drops below the predetermined excess pressure, gas flows from the second chamber 34 to the container 2 until the container pressure approximately equals the predetermined pressure. In practice the gas is normal air.

The container 2 is closed by a bottom part 4 with a so-called Nicholson plug 5 which is provided for pressurizing the pressure control device 3. On top of the container 3 a closure 6 with a valve 7 is mounted. The valve 7 has a pre-mixing chamber 8 with orifices 9 for entry of pressurized gas or air. The valve 7 is connected to a flexible dip tube 10 which is extending in the interior of the container 2 and ending almost on top of the pressure control device 3. The valve 7 has further a valve stem 11, on which a foaming chamber 12 is mounted in a sealing-fit manner. The foaming chamber 12 has an entry 13 which is circumventing the valve stem 11. Upstream of the entry 13 a base 14 with a small bore hole 15 is provided. In the foam chamber 12 two adjacent meshes 18 and 19 are provided which create uniform compact and fine foam. Upstream of the meshes 18 and 19 an outlet 20 with a cap 21 is provided for pressing the valve 7 and so dispensing the foam.

The pressure of the air filled in the pressure control device 3 is about 8 bar. The predetermined excess pressure of the air in the container 2, which is kept at a constant level by the pressure control device 3, is about 0.5 bar. Immediately over the pressure control device 3 the container 2 is filled with a fluid 25 until a predetermined level 26. Over the fluid 25 is the pressurized air 27 which is used for propelling the fluid 25 through the valve 7 and simultaneously is forced through the orifices 9 into the pre-mixing chamber 8.

Since the fluid 25 and the air 27 are mixed at a constant pressure, the foam is created very uniformly. Further the two fine meshes 18 and 19 deliver a very compact and fine foam.

The foam dispenser 1 as described above has to be used more or less in the upright position. A freshly filled foam dispenser 1 can be held also slightly slanting. However, if the foam dispenser 1 is emptying, pressurized air can flow into the dip tube 10, so that the consistency of the foam is changing and becoming thin. On the other hand, if the completely filled foam dispenser 1 is held almost horizontally, pressurized air can also flow into the dip-tube 10, so that the foam is becoming thin.

Figure 2:
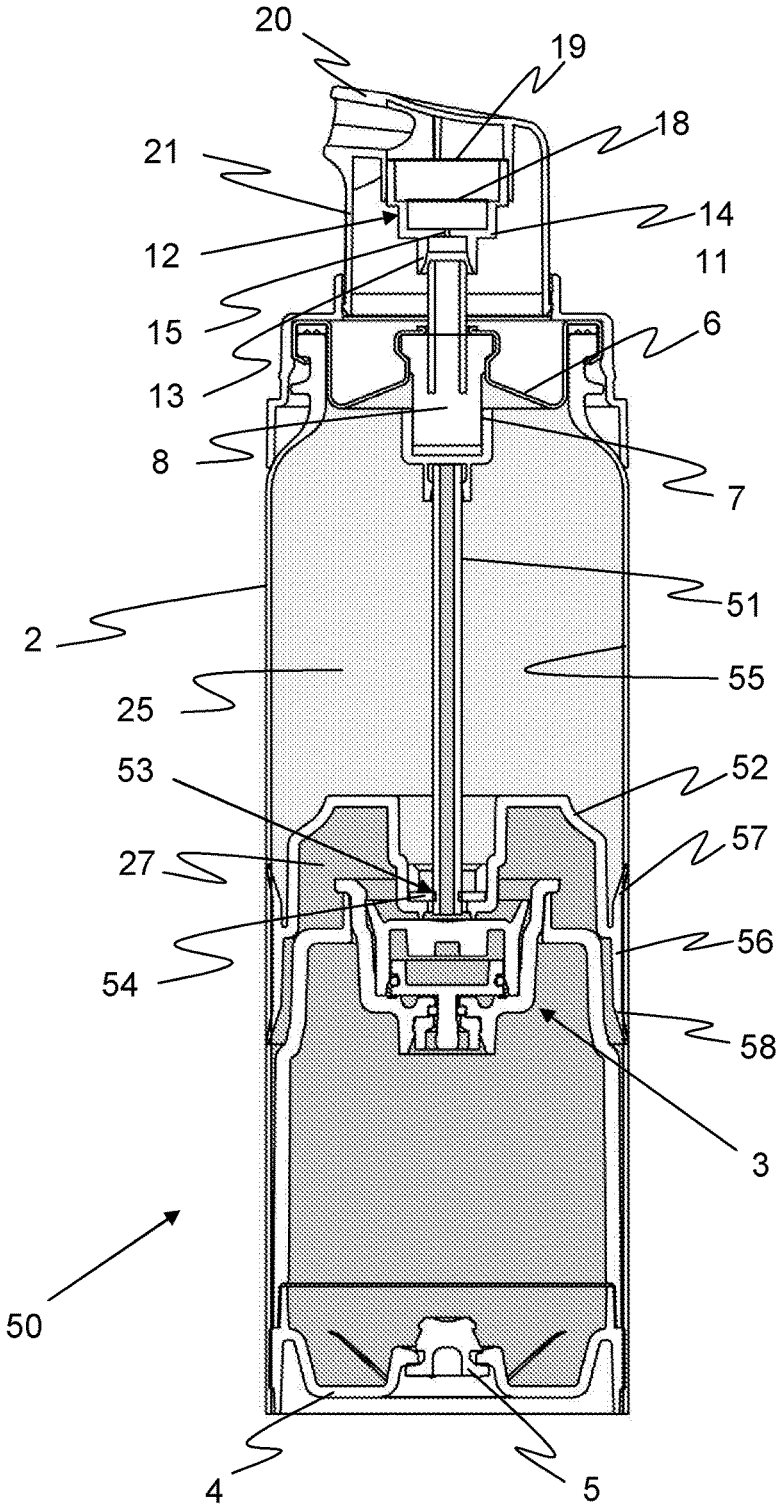
FIG. 2 shows a second embodiment of the foam dispenser.

In FIG. 2 another embodiment 50 of the foam dispenser is shown, wherein the same features have the same reference numbers as in FIG. 1. Although not depicted the pre-mixing chamber 8 has also orifices 9 as in FIG. 1. The foam dispenser 50 has a rigid dip tube 51 which is ending at a short distance to the upper end of the pressure control device 3. A dome-shaped piston 52 with a central hole 53 and a sealing O-ring 54 is circumventing the dip tube 51. Towards the inner wall 55 of the container 2 the dome-shaped piston 52 has an outer sealing ring 56 with an upper sealing lip 57 and a lower sealing lip 58. Instead of an O-ring 54 also flexible sealing lips can be provided at the border of the central hole 53.

Figure 3:
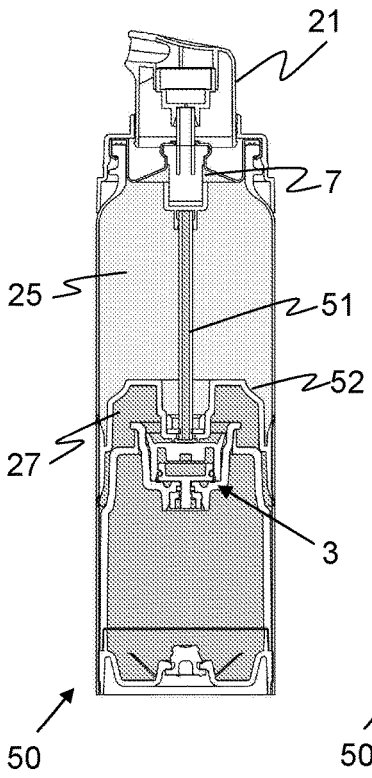
FIGS. 3 to 5 show the second embodiment in different positions to explain the working.
Figure 4:
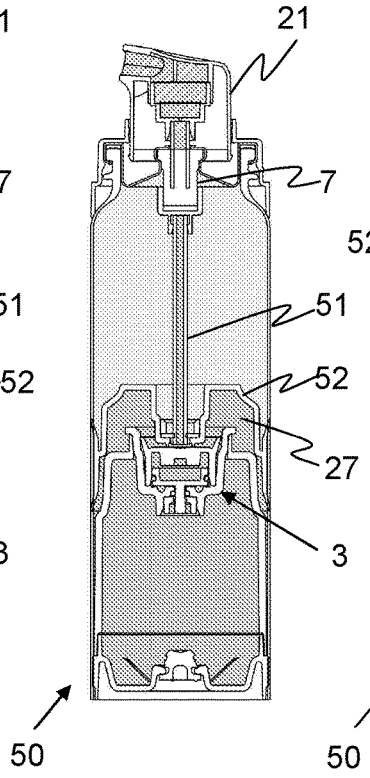
Figure 5:
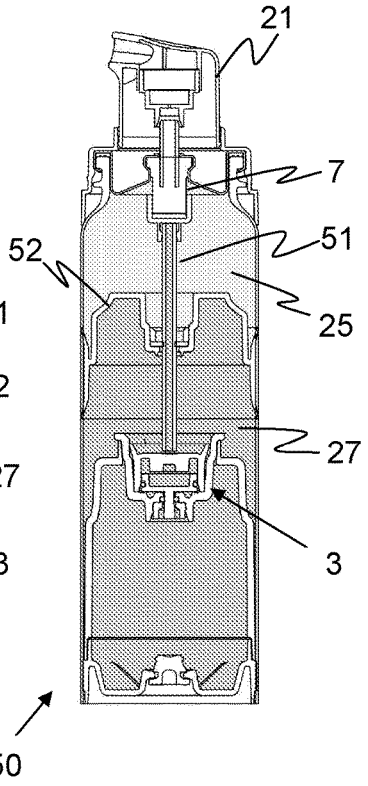

The working of the foam dispenser 50 is shown in further details in FIGS. 3 to 5. In FIG. 3 the cap or push button 21 is pushed slightly downwards, so that the valve 7 is opened to a small extent and gas or air will flow slowly through the dip-tube 51. In FIG. 4 the push button 21 is pushed more downwards, so that the valve 7 is opened to full extent and air 27 is flowing through the dip-tube 51 and simultaneously the dome-shaped piston 52 is pushed upwards by the excess pressure of the air 27 on the underside of the piston 52, so that also fluid 25 above piston 52 is flowing into the pre-mixing chamber 8 and foam is produced in the foaming chamber 12 and expelled through the outlet 20. If the push button 21 is released, the valve 7 is closed and no foam will flow anymore. Because of the underpressure of the fluid 25 over the piston 52, it is pushed upwards until there is again equilibrium of pressure under and above the piston 52. FIG. 5 shows the new equilibrium status of the foam dispenser 50.

This second embodiment 50 of the foam dispenser has the advantage that foam can be dispensed irrespective of its position, i.e., the dispenser 50 will produce foam of the same quality even if it is held upside down.

Aspects of the various embodiments described above can be combined to provide further embodiments. These and other changes can be made to the embodiments in light of the above-detailed description. In general, in the following claims, the terms used should not be construed to limit the claims to the specific embodiments disclosed in the specification and the claims, but should be construed to include all possible embodiments along with the full scope of equivalents to which such claims are entitled.

The invention claimed is:

1. A foam dispenser comprising a dispensing container with a pressurized propellant gas, a pre-mixing valve with a downstream foaming chamber wherein the pre-mixing valve comprises a valve stem and a pre-mixing chamber with orifices for entry of the pressurized gas, and that a dip-tube is connected to the pre-mixing valve, and a push button for actuating the pre-mixing valve characterized in that a pressure control device for maintaining a constant predetermined excess pressure is arranged in the dispensing container, said pressure control device comprises a first cylinder having an open end and a closed end, and a pressure regulating piston movable within said first cylinder defining a first chamber filled with a gas exerting said predetermined excess pressure, second cylinder defining a second chamber, a passageway from the second chamber to the outside of the pressure control device leading to the container, a pressure regulating valve for opening and closing said passageway, wherein the second chamber being filled with a gas at a pressure higher than said predetermined excess pressure, and said pressure regulating piston having means for actuating said pressure regulating valve dependent from a pressure difference between the first chamber and the container, so that if fluid pressure in the container drops below the predetermined excess pressure, the gas flows from the second chamber to the container until container pressure approximately equals said predetermined pressure.

2. The foam dispenser according to claim 1, wherein the downstream foaming chamber comprises two adjacent meshes for producing foam and an entry for mounting on the valve stem.

3. The foam dispenser according to claim 2, wherein the entry of the downstream foaming chamber has a reduced diameter with respect to a diameter of the valve stem.

4. The foam dispenser according to claim 1, wherein a fluid expelling piston with a hole is provided within the container, wherein the dip-tube is penetrating the fluid expelling piston through the hole.

5. The foam dispenser according to claim 4, wherein the hole is sealed to the dip-tube by a sealing O-ring or by sealing lips.

6. The foam dispenser according to claim 4, wherein the fluid expelling piston is dome-shaped.

7. The foam dispenser according to claim 6, wherein the fluid expelling piston has an outer sealing ring with an upper sealing lip and a lower sealing lip.

* * * * *